US005741206A

United States Patent [19]

Anastasi

[11] Patent Number: 5,741,206

[45] Date of Patent: Apr. 21, 1998

[54] BODY CONTOURED WEIGHT FOR PHYSICAL FITNESS HAVING AN INTEGRAL HANDLE

[76] Inventor: Christopher Anastasi, 26433 Portola, Mission Viejo, Calif. 92692

[21] Appl. No.: 632,562

[22] Filed: Apr. 15, 1996

[51] Int. Cl.[6] ..... A63B 21/065; A63B 21/072

[52] U.S. Cl. ..... 482/105; 482/93; 482/106; 482/108; 482/141

[58] Field of Search ..... 482/92–94, 105, 482/106, 108, 44, 79, 107, 141; D21/196–198

[56] References Cited

U.S. PATENT DOCUMENTS

| | | | |
|---|---|---|---|
| D. 274,283 | 6/1984 | Wright . | |
| D. 299,373 | 1/1989 | Parker et al. . | |
| D. 354,322 | 1/1995 | Vodhanel, Jr. | D21/196 |
| D. 355,007 | 1/1995 | Rojas et al. | D21/196 |
| 721,029 | 2/1903 | Dubler . | |
| 850,964 | 4/1907 | Pelletier et al. | 482/108 |
| 907,965 | 12/1908 | Calvert | 482/108 |
| 1,047,212 | 12/1912 | Hamilton . | |
| 1,291,465 | 1/1919 | Foreman . | |
| 2,214,052 | 9/1940 | Good | 482/79 |
| 3,039,273 | 6/1962 | Swindell | 482/105 |
| 3,572,702 | 3/1971 | Dorn . | |
| 3,771,785 | 11/1973 | Speyer . | |
| 3,796,431 | 3/1974 | Sinyard . | |
| 4,079,932 | 3/1978 | Schuetz . | |
| 4,199,140 | 4/1980 | Ferretti | 482/106 |
| 4,369,967 | 1/1983 | Kimura . | |
| 4,373,717 | 2/1983 | Lambert, Jr. . | |
| 4,384,714 | 5/1983 | Kimura . | |
| 4,789,270 | 12/1988 | Selisky . | |
| 4,854,575 | 8/1989 | Wilson et al. . | |
| 4,966,365 | 10/1990 | Winston . | |
| 4,995,604 | 2/1991 | Lynch et al. | 482/93 |
| 5,137,502 | 8/1992 | Anastasi . | |
| 5,250,014 | 10/1993 | Chang . | |

FOREIGN PATENT DOCUMENTS

| | | | |
|---|---|---|---|
| 428519 | 7/1967 | Switzerland | 482/105 |
| 1409295 | 7/1988 | U.S.S.R. | 482/93 |
| 3736 | 3/1887 | United Kingdom | 482/105 |

*Primary Examiner*—Richard J. Apley
*Assistant Examiner*—Victor K. Hwang
*Attorney, Agent, or Firm*—Price, Gess & Ubell

[57] ABSTRACT

A weight device which is cross-sectionally contoured to fit particular portions of an exerciser's body, the weight device being further longitudinally curved or radiused along first and second sides and includes a circular opening in the center and a pair of diametrically opposed, elongated openings disposed parallel to one another and equidistant from the circular opening so that the fingers and thumb of a human hand may be disposed through the openings for sufficient gripping of the weight.

1 Claim, 1 Drawing Sheet

BODY CONTOURED WEIGHT FOR PHYSICAL FITNESS HAVING AN INTEGRAL HANDLE

BACKGROUND OF THE INVENTION

1. Field of the Invention

The subject invention relates generally to physical fitness equipment and, more particularly, to a weight device which is cross-sectionally contoured for application to particular body parts and which is also useful as an exercise implement for push-ups, sit-ups, and bar dips.

2. Description of Related Art

It is known in the prior art to use weighting devices applied to particular body parts for various exercise purposes. Some familiar examples are strap-on-type weighted ankle belts and the use of a barbell weight plate held behind the head while doing sit-ups. Such devices exhibit various disadvantages. The use of flat plates for sit-ups, for example, is particularly uncomfortable and difficult because such plates tend to pivot from side to side and to focus gripping force on a small area of the head, which can be quite uncomfortable.

Flat weight plates that are used with dumbbells and barbells are also difficult to grasp and use as an independent exercise implement. The weights increase in diameter and width as the size of weight increases. Weights are typically in pound increments of 2½, 5, 10, 25, 35, and 45 pounds. Typical weight plates sold are difficult to hold because they do not give way to pressure applied when grasping them. Thus, weights tend to slip out of the user's hand when mounting them onto the barbell or dumbbell or when trying to use the weight alone as an exercise implement. Thus, the use of an independent weight as an exercise implement can be dangerous when the weight slips out of one's hand, and may cause harm to the user or persons or property nearby.

OBJECTS AND SUMMARY OF THE INVENTION

It is therefore an object of the present invention to provide an improved weight used for physical fitness;

It is a further object of the invention to provide a weight that has an integrally-formed curve contoured to fit particular portions of the human body;

It is another object of the invention to provide a weight contoured to the human body which may be securely held by a single human hand; and It is a further object of the invention to provide a weight contoured to the human body which has an integrally-formed gripping means.

These and other objects and advantages of the present invention are achieved by providing a weight device having a generally constant thickness and a cross-sectional contour adapted to fit a portion of the human body. The contour may be radiused, parabolic, elliptical, various other curves, or a complex molded contour. In a preferred embodiment, the weight device includes a pair of diametrically opposed, elongated openings disposed parallel to one another and equidistant from the circular opening. The openings are positioned in the curved outer surface of the device so that the fingers and thumb of a human can be disposed through the openings for sufficient gripping of the weight. The distance between the outer periphery of the elongated side of either opening adjacent to the outer periphery of the weight device is dimensioned so that the fingers of the human hand can be disposed through the opening and the thumb can be wrapped around the outer periphery of the weight. The periphery of the elongated openings and outer periphery of the weight are rounded to aid in gripping of the weight.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

Figure 4:
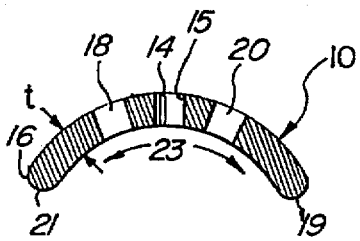
FIG. 4 is a cross-sectional view of the preferred embodiment of the present invention taken at 4—4 of FIG. 2.

FIGS. 1–4 show a weight 10 constructed according to the preferred embodiment of the present invention. The weight 10 is a generally solid concave metal mass of constant thickness "t" and having symmetrically curved longitudinal side portions 19, 21. As seen in FIG. 4, the weight has a curved cross-section 23, which may be semicircular, elliptical, parabolic, or a more complex curve.

The weight means has a circular opening 14 disposed in the center thereof. Disposed on either side of the circular opening 14 are a pair of diametrically opposed, elongated openings 18, 20. The openings 18, 20 are disposed parallel to one another and equidistant from the circular opening 14. The openings 18, 20 are positioned so that the fingers and thumb of a human hand (not shown) can be disposed through the openings 18, 20 for sufficient gripping of the weight 10.

Figure 8:
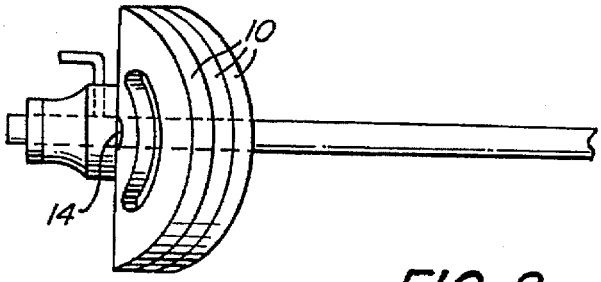
FIG. 8 is a side view, partially in phantom, of the invention mounted on an exercise bar.

The distances between an outer elongated side 26, 28 of either of the openings 18, 20 is dimensioned so that the fingers of the human hand can be disposed through the desired opening 18, 20 and the thumb can be wrapped around the outer periphery 16 of the curved disc member 12 for sufficient gripping of the weight 10. The optional circular opening 14 may be different diameters to accommodate different barbells and dumbbells, should it be desired to bar-mount the weight 10 (see FIG. 8). In the preferred embodiment, the diameter of the circular opening 14 is approximately 1¼ inches. Inner sides 30, 32 of the openings 18, 20 may be disposed ¾ inch from the outer periphery 15 of the circular opening 14. The outer sides 26, 28 of the respective openings 18, 20 are 1½ inches from the respective longitudinal sides 19, 21 of the weight 10. The openings 18, 20 may be 4 inches in length and have a width of 1½ inches which, of course, may be varied. The inner periphery 30, 32 of the respective openings 18, 20 is rounded to aid in gripping the weight 10. The weight 10 may comprise a suitable metal, such as iron. The weight 10 may be covered with a plastic, vinyl, rubber, or neoprene coating (not shown) for added comfort when gripping the weight 10. The weight 10 may also comprise a rigid plastic shell filled with sand.

Figure 1:
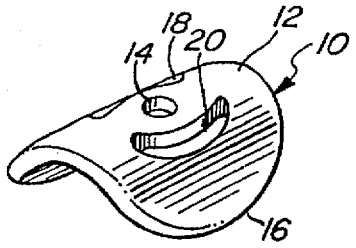
FIG. 1 is a perspective view of a preferred embodiment of the present invention.
Figure 2:
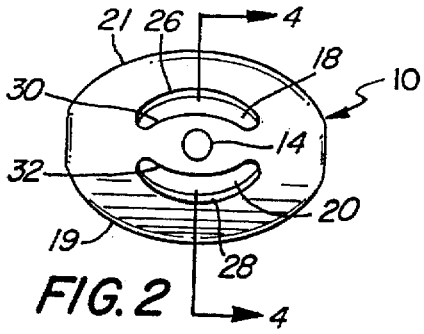
FIG. 2 is a top view of the preferred embodiment.
Figure 3:
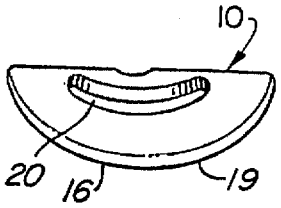
FIG. 3 is a side elevational view of the preferred embodiment.

FIG. 2 shows a top view of the invented weight 10. Both elongated openings 18, 20 have their centers aligned with the center of the circular opening 14. The openings 18, 20 are disposed parallel to one another in the weight 10 and equidistant to the circular opening 14.

FIG. 4 shows a cross-sectional view of the invented weight 10 taken along the lines A—A of FIG. 2. The circular opening 14 has its inner periphery 15 perpendicular to the top and bottom surfaces of the weight 10 to aid in coupling the weight 10 to a barbell or dumbbell. The generally rounded nature of the peripheral edge of the weight 10 and the rounded nature of the openings 18, 20 enhances grasping of the weight 10.

Figure 6:
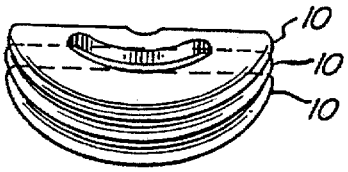
FIG. 6 is a side view of a stack of a number of weights constructed according to the preferred embodiment.
Figure 5:
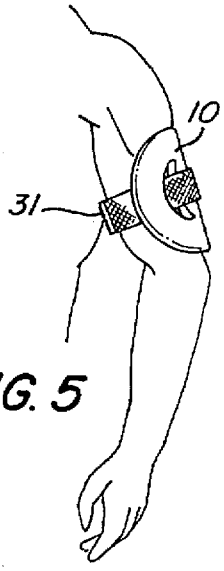
FIG. 5 is a partial perspective view illustrating application of the preferred embodiment to a portion of the human anatomy.

The contour applied to the inner surface of the weight 10 permits it to comformably mount about a portion of the human anatomy. FIG. 5 illustrates application of the contoured weight 10 to a human arm and use of a strap or belt 31 inserted through the openings 18 and 20 to hold the weight 10 in place. FIG. 6 illustrates the conveniently stackable nature of a number of identical weights 10.

When using the weight 10, the fingers of the human hand may be placed through either elongated opening 18, 20, and the thumb of the hand may be placed through the remaining opening 18, 20 to grip the weight 10. By holding the weight 10 in this fashion, exercises such as those usually performed with dumbbells may be performed. The invented weight 10 may also be held by placing the fingers of the hand through the desired opening 18, 20 and wrapping the thumb around the outer periphery 16 of the curved disc member 12 to grip the weight 10. Exercises using the weight independently of any other apparatus may also be performed by holding the weight in this fashion. The openings 18, 20 also enhance the ease with which the weight 10 may be placed onto a desired barbell or dumbbell. The fingers of one hand may be placed through the desired opening 18, 20, and the thumb is then wrapped around the curved disc member's 12 adjacent outer periphery 16, and the fingers of the remaining hand may be placed through the remaining opening 18, 20, and the thumb wrapped around the adjacent outer periphery 16 of the curved disc member 12 to securely grip the weight 10 with both hands. The weight may then be lifted and placed onto a desired barbell or dumbbell by disposing the barbell through the circular opening 14.

Figure 7:
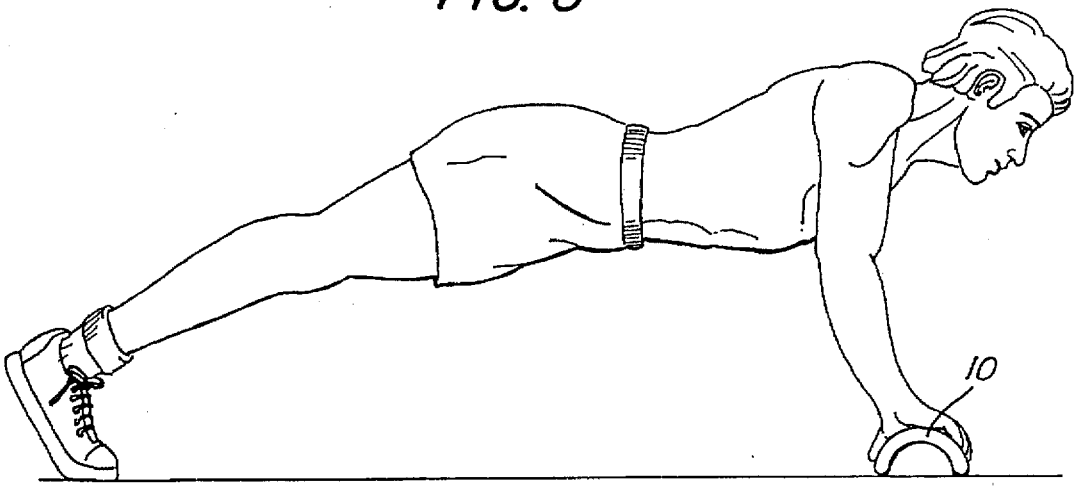
FIG. 7 is a side view illustrating use of a weight configured according to the preferred embodiment as an exercise implement to angulate the body during a push-up exercise.

The preferred embodiment of the present invention provides a body-contoured weight having a gripping means for holding the weight. The contoured weight also has a novel, aesthetically pleasing appearance, can be neatly and conveniently stacked as illustrated in FIG. 6, and can also be used as an exercise implement for sit-ups, bar dips, push-ups, and other exercises. The use of the weight according to the preferred embodiment placed beneath the hand so as to angulate the body during a push-up exercise is shown in FIG. 7.

Those skilled in the art will appreciate that various inner contours can be provided to fit various sized arms or to fit various body parts such as the calf, neck, ankle, etc. The gripping means of the invented weight enhances the weight's use as an independent exercise implement and as an effective way to hold the weight to prevent it from slipping from one's hand. Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specified described herein.

What is claimed is:

1. A curvilinear exercise weight comprising a rigid plate having a central opening sized and configured to receive an end of an exercise bar, wherein said rigid plate may be used as a weight on a barbell or dumbbell;

first and second openings on said rigid plate spaced from and located on opposite sides of said central opening, each of said first and second openings sized and configured to permit a user to grasp the exercise weight between a respective opening and an edge of the rigid plate;

said rigid plate having a concave curvature; and a strap passing through said first and second openings, wherein said strap is used to secure said rigid plate to the user's body and said concave curvature of the plate conforms to the contour of the user's body.

* * * * *